United States Patent [19]

Auinger et al.

[11] 3,942,643

[45] Mar. 9, 1976

[54] SUPERCONDUCTING MAGNETIC SEPARATOR

[75] Inventors: Herbert Auinger, Nurnberg; Franz Bohm, Grossgrundlach; Helmut Kuckuck; Hans Voigt, both of Erlangen, all of Germany

[73] Assignee: Siemens Aktiengesellschaft, Munich, Germany

[22] Filed: Feb. 6, 1974

[21] Appl. No.: 440,048

[30] Foreign Application Priority Data

Feb. 14, 1973 Germany ..... 2307273

[52] U.S. Cl. ..... 209/81 A; 209/223 A

[51] Int. Cl.[2] ..... B03C 1/14; B03C 1/22

[58] Field of Search ..... 209/81 A, 81 R, 223 R, 209/223 A, 222, 232, 216, 218, 219

[56] References Cited

UNITED STATES PATENTS

| | | | |
|---|---|---|---|
| 1,295,857 | 3/1919 | Craft | 209/223 R X |
| 2,591,121 | 4/1952 | Blind | 209/218 X |
| 2,612,262 | 9/1952 | Symington | 209/232 X |
| 3,375,925 | 4/1968 | Carpenter | 209/214 |
| 3,497,061 | 2/1970 | Ferris | 209/223 R |

*Primary Examiner*—Robert B. Reeves
*Assistant Examiner*—Thomas E. Kocovsky
*Attorney, Agent, or Firm*—Kenyon & Kenyon Reilly Carr & Chapin

[57] ABSTRACT

A continuously operating superconducting magnetic separator for the segregated separation of particles with different magnetic susceptibility from a mixture such as a mixture of ferromagnetic and non-ferromagnetic ore and rock, in which the magnetic separator comprises a stationary superconducting magnet arrangement along with at least one carrier running through the magnetic field for the particles to be separated, which particles are moved by means of a conveyer chute through the magnetic field of large volume and past the carrier, which is in the form of a ferromagnetic grid, generating a field gradient and forcing the particles onto the grid, from which they are carried to appropriate collection devices.

16 Claims, 8 Drawing Figures

SUPERCONDUCTING MAGNETIC SEPARATOR

BACKGROUND OF INVENTION

This invention relates to magnetic separators in general, and more particularly to an improved separator which may be efficiently operated. Magnetic separators are known in which a mixture of particles having different magnetic susceptibilities, (magnetic susceptibilities will hereandafter be designated by the symbol (k)), is led continuously through the field of a stationary superconducting magnet arrangement and subjected to the influence of the product of the induction B and its local field gradient grad B. In such an arrangement, particles of a given susceptibility are continuously separated magnetically from the mixture by means of a carrier running through the magnetic field and are removed from the carrier outside the influence of the magnetic field.

One such separator of this type is described in U.S. Pat. No. 3,503,504 and comprises a sector-shaped magnet arrangement consisting of a multiplicity of small, superconducting magnet coils which are arranged beside each other and which are alternately excited in one and the other direction in order to generate the needed field gradients. Around the magnet arrangement a closed hollow cylinder of hard rubber or non-magnetic steel coated with hard rubber and which acts as the carrier rotates at a close axial distance. The carrier also encloses the cryostat of the superconducting magnet arrangement with it in turn surrounded by a stationary, hollow, cylindrical housing with an inlet for the mixture and separate outlets located underneath for the magnetic particles which have been separated and for the other components of the mixture. Although it is indicated that magnet coils field strengths of 3.5 tesla are attainable in the immediate vicinity of the magnet coils, only 0.7 tesla are at most available at the separation region itself, i.e., outside the wall of the carrier. This is no more than that in previously known electromagnetic separators such as that of U.S. Pat. No. 3,289,836. In electromagnetic separators of that type, a large number of small electromagnets are placed along a conveyor and separation arrangement for the mixture with the electromagnets continuously moved at constant spacings along the separation device. Clearly, such an arrangement is expensive since a large separator of electromagnets and heavy complicated support and handling devices along with flushing devices are required. The attraction force $F = k$. B.grad B on magnetizable particles, which are attainable with known superconducting or electromagnetic separators, are sufficient only for separating ores which have a relative high magnetizability. Such ores are essentially ferromagnetic ores such as magnetite and hematite. Non-ferromagnetic ores having smaller susceptibilities cannot be handled at all with these magnetic separators. If, for example, magnetite and hematite are to be extracted separately from a mixture when using the prior art devices, than either a magnetic separator with a product of induction and field gradient tuned to the susceptibility of magnetite and a second magnetic separator following the first on the transport path, having a higher attraction force tuned to hematite are required, or alternatively, the mixture must be run through the magnetic separator twice, after the excitation of the latter has been suitably increased. For a large number of particles of different susceptibility, correspondingly larger numbers of separators or repeated runs with changed excitation are required.

Thus, it can be seen that there is a need to generate high inductions and field gradients at a lower cost in such magnet arrangements as well as keeping the carriers and separation devices simple while maintaining continuous-throughput operation with satisfactory separation of even relatively weakly magnetizable particles, and to be able to sort the different components according to their susceptibility.

SUMMARY OF INVENTION

The present invention solves this problem using a superconducting magnetic separator, basically of the type described above, and by providing a superconducting magnet arrangement which produces a magnetic field of large volume which is arranged to penetrate the mixture moving past it, along with providing at least one ferromagnetic grid which produces a field gradient and acts as the carrier.

Preferably, the magnet arrangement will be composed of at least two superconducting magnets, hereafter referred to as the pair of magnets, which are arranged opposite each other on both sides of a transport path for the mixture and between which the ferromagnetic grid or grids are moved through the magnetic field close to the mixture being transported. As used herein, a grid refers to a planar integral grid structure which is adapted for movement past the transport path for the mixture. Typical examples of what is meant by a planar integral grid structure are a grid in the form of a rotating drum or a grid in the form of an endless belt. A magnetic field of large volume in the order of, for example, 4 to 8 tesla can be produced by such a magnet arrangement. The required local field gradients can be changed and adapted through the ferromagnetic grid or grids over a wide range, so that a product of B and grad B is obtained, which product is several times that obtainable with prior art magnetic separators. Because of the physical size of the magnetic field of a pair of magnets, a continuous or finely graduated increase of the product B grad B, which determines the attraction forces, can be obtained in this magnetic field either by obliquely positioning superconducting excitation coils, by interposing iron bodies and/or through the use of an appropriately non-uniform grid structure in the grids which are used as the carrier, thereby permitting in a magnetic separator of this type, particles of different susceptibility to be separated in a single pass.

Thus, with the superconducting magnetic separator of the present invention, it is possible to separate particles in a considerably larger susceptibility range, and to do this, if desired, with selectivity in small steps, so that, for example, ore with a susceptibility smaller than that of the accompanying dead rock can be cleanly separated and extracted.

In transporting the material or mixture passed between the pair or pairs of magnets, a conveyor belt or conveyor chute or the like, with the mixture in either dry or wet form may be used.

DETAILED DESCRIPTION OF THE PREFERRED EMBODIMENT

Figure 1:
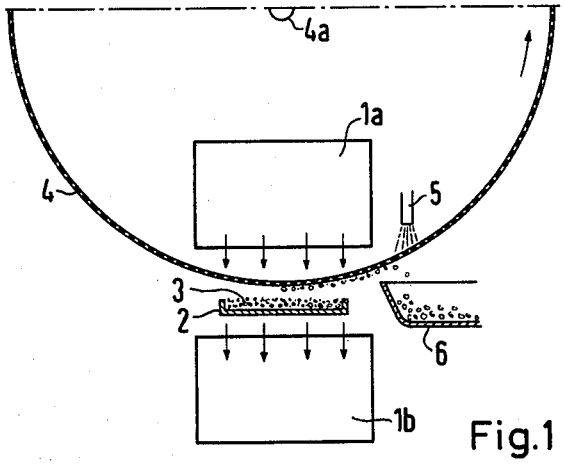
FIG. 1 is an elevation view, partially schematic in form and partially in cross section, of a magnetic separator with one pair of magnets and at least one cylindrical ferromagnetic grid.
Figure 2:
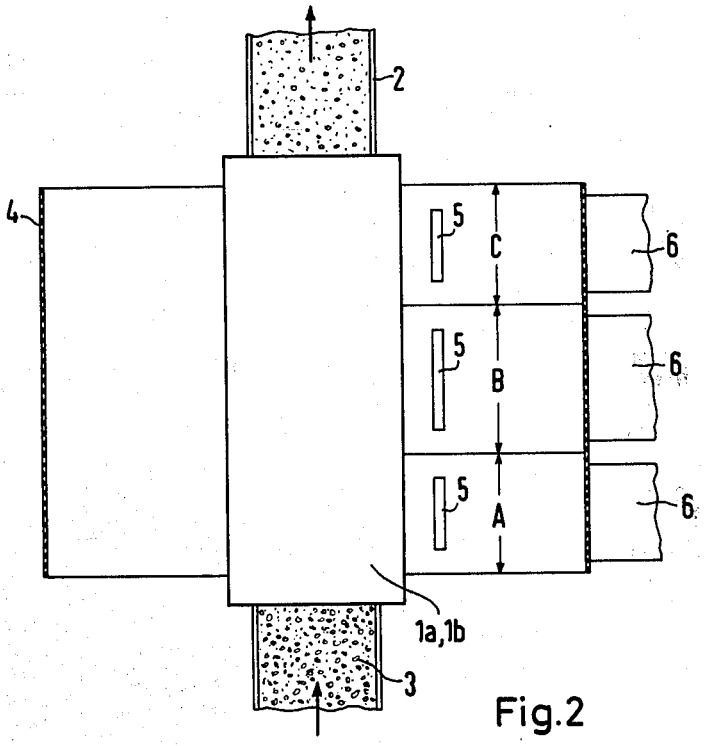
FIG. 2 is a plan view of the embodiment of FIG. 1.
Figure 1A:
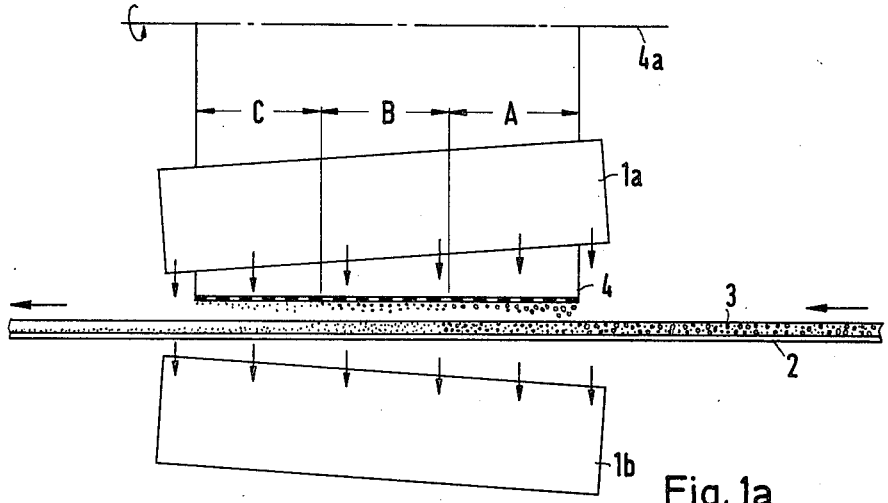
FIG. 1*a*. is a view illustrating a manner of establishing an increase in the magnetic field using obliquely positioned superconducting coils.
Figure 1B:
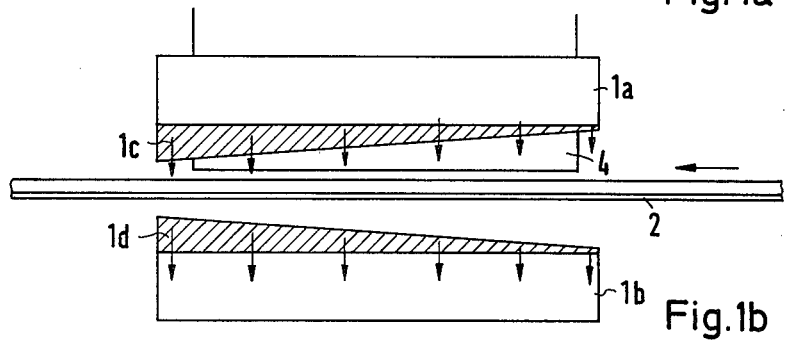
FIG. 1*b*. is a similar view showing the same results achieved using interposed iron bodies.
Figure 2A:
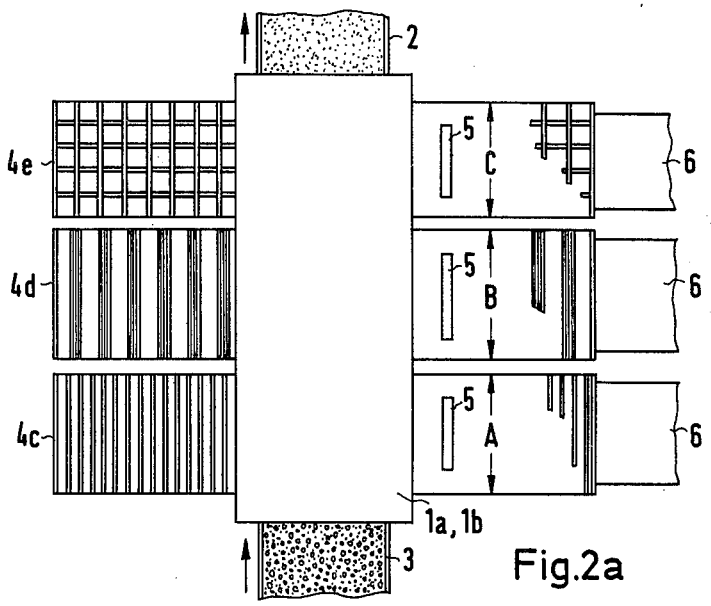
FIG. 2*a*. is a view similar to the view of FIG. 2 showing how appropriately non-uniform grid structures may be used to separate particles of different susceptibilities.

A first embodiment of the invention is illustrated by FIGS. 1 and 2. Here, two superconducting magnets, 1*a* and 1*b*, which will, in conventional fashion, include excitation windings along with cryostats are arranged above and below a conveyer belt or conveyer chute 2, in which the mixture 3 is transported, parallel to the magnets. As illustrated, the two magnets are excited in the same sense, so that their common field is normal to the conveyor direction. Between the upper magnet 1a and the mixture 3, a cylindrical ferromagnetic grid 4, which revolves about an axis of rotation 4*a*, disposed above the upper magnet 1*a* and parallel to the lengthwise direction of the conveyor belt 2 is provided. Means will be provided in conventional fashion to rotate the grid 4 at constant speed. Through the influence of the induction and the field gradient effect at the grid 4, magnetizable components of the mixture are attracted to the outside surface of the grid, which are thereby transported out of the range of the magnetic field in the direction of the arrow. Once out of the magnetic field, the adhering particles reach a position where there is installed a flushing device 5 which may comprise means for directing compressed air or flushing water on the grid. The flushing device 5 dislodges the particles from the grid 4 and propells them to a collecting device 6 which may be a conveyor belt, conveyor chute or collecting trough, and which is laterally arranged below the grid 4. At the same time, this ensures that the grid is cleaned and protected against sticking. As illustrated by FIG. 2, the magnet arrangement can be subdivided in the lengthwise direction into several regions A, B and C with attraction forces that increase in the transport direction. One manner of accomplishing this is illustrated by FIG. 1*a*. As shown thereon, a continuous increase of the product B.grad B, which determines the attraction forces, can be achieved in a simple manner by inclining the magnets 1*a* and 1*b* on opposite sides of the conveyor chute toward the conveyor chute in the transport direction, i.e., the direction of the arrow. As shown, the rear ends of the magnets are arranged at a shorter distance from each other and the conveyor chute in their front ends. A second possibility of achieving the same result is illustrated by FIG. 1*b*. In this embodiment, the magnet 1*a* and 1*b* are arranged parallel to the conveyor chute but have their undersides equipped with iron bodies 1c and 1d which have an increasingly smaller distance from the conveyor chute toward the rear end. It is also possible to provide obliquely positioned magnets with such iron bodies whereby less inclination of the magnet is by itself sufficient for obtaining, together with the iron bodies, the desired effect. A third method of achieving a graduated increase in attaction forces is that illustrated by FIG. 2*a*. Here, instead of using a uniform illustrated as illustred in FIGS. 1 and 2, three differently structured, separately driven grids 4 *c*, 4*d* and 4*e* are provided one next to the other in the lengthwise direction of the conveyor chute 2 in the region of the parallel magnets 1a and 1b. Of these grids, the front grid 4*c* excerts the smallest attraction force and the rear grid 4*e*, the highest attraction force on the passing mixtures. As shown in FIGS. 2 and 2*a*, with any of these arrangements for obtaining selective separation of particles with different susceptibility through the use of the zones A, B and C, separate flushing devices 5 and collection devices 6 are provided for each zone. In each case, only one pair of magnets and one ferromagnetic grid is required. Also, as indicated by FIG. 2 on the right hand side, rather than using a single grid drum, separate grid drums corresponding to the zones A, B and C may be used, much in the manner indicated on FIG. 2*a*, but with the same grid structure, when used in an arrangement such as that of FIG. 1*a* or FIG. 1*b*. In addition, the axis of rotation of the grid 4 may be placed below the magnet 1*b*, in which case the flushing devices and the collecting devices will be located inside the drum and the product must be brought out at the end face.

Figure 3:
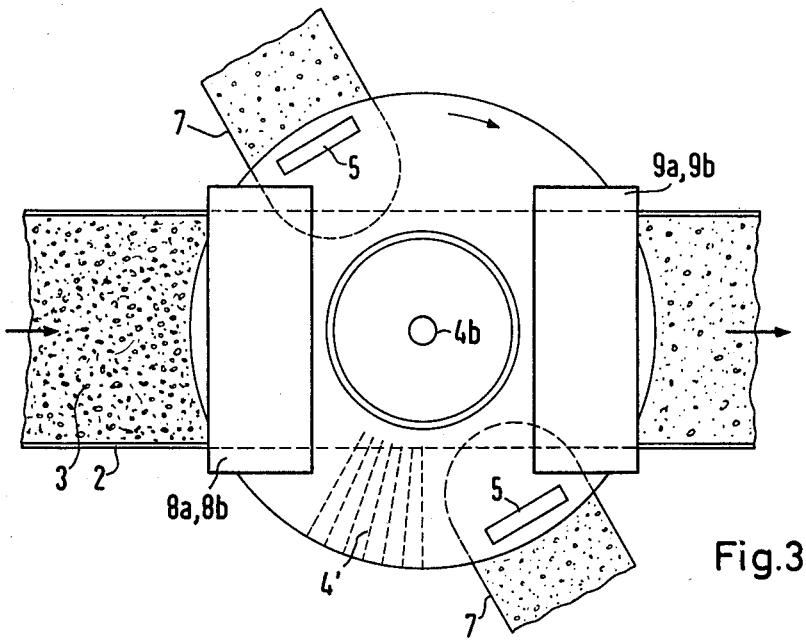
FIG. 3 is a plan view of a second embodiment of the invention in which the carrier grid is in the form of a disc.
Figure 4:
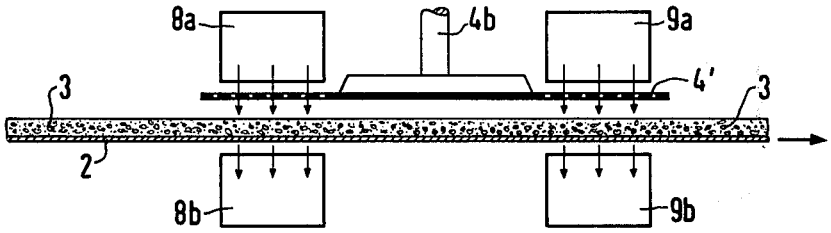
FIG. 4 is an elevation view of the arrangement of FIG. 3.

A further embodiment of the invention which is quite compact is illustrated by FIGS. 3 and 4. Here, two pairs of magnets 8*a* and 8*b* and 9*a* and 9*b* are arranged on both sides of the conveyor belt or chute 2 much in the manner described above. However, this embodiment, rather than using a cylindrical grid, a disc-shaped ferromagnetic grid 4′ is provided. Collection means 7 are provided below the disc outside the magnetic fields and flushing devices 5 provided to operate in the manner described above. The two pairs of magnets may be set to separate particles of different susceptibilities; thus, the magnets 8*a* and 8*b* may be adjusted to separate particles of higher susceptibility and the magnets 9*a* and 9*b* to separate particles of lower susceptibility. The output obtained from the magnets 8*a* and 8*b* will be deposited in the collection device 7 at the top of the figure and those collected from the magnets 9*a* and 9*b* at the collection device 7 in the lower part of the figure. As in the previous embodiment, compressed air or flushing water may be used at the flushing devices 5. Furthermore, if desired, each pair of magnets can be sub-divided in the transport direction of the mixture, much in the manner shown in FIG. 2, into zones having different attraction forces. In this way, more than two different particles can be separated from the mixture selectively. Through the use of a flat grid, a magnetic separator with relatively small structural height is obtained.

Figure 5:
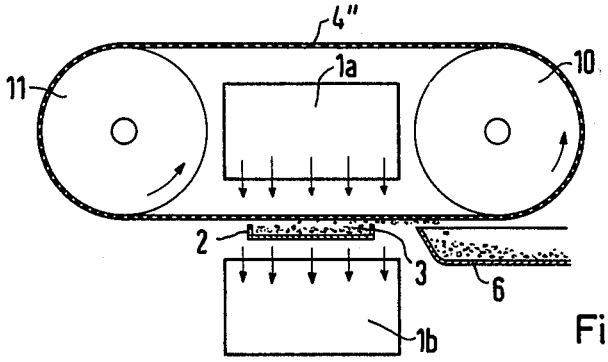
FIG. 5 is an elevation view of a further embodiment of the invention with the grid in the form of an endless belt.

A further embodiment of the invention is illustrated by FIG. 5. This is an arrangement which is easy to manage from a design standpoint and can be adapted to different operating conditions in many ways and, in addition, requires little space. Instead of the drum or disc, an endless belt 4″ is advantageously used as the ferromagnetic grid. As shown, the belt is driven by the rollers 10 and 11, arranged on opposite sides of the conveyor belt or conveyor chute 2 and moves transversely to the transport path of the mixture 3. The remaining parts of the magnetic separator are identical to those in FIG. 1 and 2 and are given identical reference numerals. In a manner similar to the example given in connection with FIGS. 1 and 2, the ferromagnetic structure of the endless belt may be made different over the belt width, i.e., in the direction of the transport movement of the mixture 3 along its transport path. That is, it can be made to have an increasing field gradient or, alternatively, belts of different types having grid patterns such as those of FIG. 2*a* arranged side-by-side to form individual zones A, B and C. In addition, selectively can be increased by driving the individual belts at different speeds. The endless belt or belts 4'' may consist of ferrogmagnetic material and have a structure serving to generate the required field gradient, e.g., they may be in the form of perforated strip material, link chains or the like. However, the belts can also be made of another flexible material which is used as the carrier for ferromagnetic strutures structures then serve for the generation of the field gradient.

Thus, a number of embodiments of an improved magnetic separator have been shown. Although specific embodiments have been illustrated and described, it will be obvious to those skilled in the art that various modifications may be made, without departing from the spirit of the invention which is intended to be limited solely by the appended claims.

What is claimed is:

1. A continuously operating superconducting magnetic separator in which a mixture of particles of different magnetic susceptibility is led through the field of a stationary superconducting magnet arrangement and subjected to the influence of the product of the induction B and its local field gradient grad B, and in which particles of a given susceptibility are continuously separated magnetically from the mixture by means of a carrier running through the magnetic field and are removed from the carrier outside of the influence of the magnetic field wherein the improvement comprises:

a. a magnet arrangement generating a magnetic field of large volume which penetrates the mixture moving past the field; and b. a carrier including at least one planar integral ferromagnetic grid generating a field gradient.

2. A magnetic separator according to claim 1 wherein the magnetic arrangement comprises at least two superconducting magnets arranged opposite each other on opposite sides of the transport path and wherein the ferromagnetic grid is removed through the magnetic field in closed proximity to the mixture being transported.

3. A magnetic separator according to claim 2 wherein a single ferromagnetic grid is provided having a grid structure along the transport path of the mixture which results in an increasing field gradient, and which extends over the entire length of the magnet arrangement.

4. A magnetic separator according to claim 3 wherein separate individually moveable grids of different grid structure are provided to define individual zones of increasing field gradient.

5. A magnetic separator according to claim 2 wherein the ferromagnetic grid is moved through the magnetic field transversly to the transport direction of the mixture.

6. A magnetic separator according to claim 5 wherein said ferromagnetic grid comprises a drum and wherein the axis of rotation of said drum is arranged above the transport path of the mixture and outside the magnet arrangement with its axis parallel to the transport path.

7. A magnetic separator according to claim 5 wherein said ferromagnetic grid is an endless belt driven by two rollers arranged on opposite sides of the transport path.

8. In a continuously operating superconducting magnetic separator in which a mixture of particles of different magnetic susceptibility is led through the field of a stationary magnetic conducting magnet arrangement and subjected to the influence of the product of the induction B and its local field gradient grad B, and in which particles of a given susceptibility are continuously separated magnetically from the mixture by means of a carrier running through the magnetic field and are removed from the carrier outside of the influence of the magnetic field the improvement comprising:

a. a magnet arrangement generating a magnetic field of large volume which penetrates the mixture moving past the field said magnet arrangement comprising at least two pairs of superconducting magnets arranged opposite each other on opposite sides of the transport path said magnets energized to have increasing field strength in the direction of transport; and b. a carrier including at least one common ferromagnetic grid associated with all pairs of magnets said ferromagnetic grid being moved through the magnetic field in close proximity to the mixture being transported transversely to the transport direction of the mixture, said ferromagnetic grid generating a field gradient.

9. A magnetic separator according to claim 8 wherein said ferromagnetic grid comprises a perforated steel disc having an axis of rotation which is perpendicular to the transport direction of the mixture and is located between the pairs of magnets.

10. In a continuously operating superconducting magnetic separator in which a mixture of particles of different magnetic susceptibility is led through the field of a stationary magnetic conducting magnet arrangement and subjected to the influence of the product of the induction B and its local field gradient grad b, and in which particles of a given susceptibility are of a carrier running through the magnetic field and are removed from the carrier outside of the influence of the magnetic field the improvement comprising:

a. a magnetic arrangement generating a magnetic field of large volume which penetrates the mixture moving past the field said magnetic arrangement comprising at least two superconducting magnets arranged opposite each other on opposite sides of the transport path said magnets energized to have increasing field strength in the direction of transport and wherein zones of increasing strength are thereby defined; and b. a carrier including at least one ferromagnetic grid said ferromagnetic grid being moved through the magnetic field in close proximity to the mixture being transported transversely to the transport direction of the mixture, said ferromagnetic grid generating a field gradient.

11. A magnetic separator according to claim 10 wherein said means comprise obliquely positioned superconducting excitation coils.

12. A magnet separator according to claim 10 wherein said means comprise iron bodies interposed between said magnets and the mixture.

13. A magnetic separator according to claim 10 and further including a flushing device and collecting device for the separated particles associated with each ferromagnetic grid and positioned outside of each magnet arrangement.

14. A magnetic separator according to claim 10 wherein a single ferromagnetic grid is provided having a grid structure along the transport path of the mixture which results in an increasing field gradient, and which extends over the entire length of the magnet arrangement.

15. A magnetic separator according to claim 14 wherein separate individually moveable grids of different grid structure are provided to define individual zones of increasing field gradient.

16. A magnetic separator according to claim 15 and further including a flushing device and collecting device for the separated particles associated with each ferromagnetic grid and positioned outside of each magnet arrangement.

* * * * *

UNITED STATES PATENT AND TRADEMARK OFFICE

CERTIFICATE OF CORRECTION

PATENT NO. : 3 942 643

DATED : March 9, 1976

INVENTOR(S) : Herbert Auinger et al

It is certified that error appears in the above-identified patent and that said Letters Patent are hereby corrected as shown below:

Column 4, line 6: After the word "uniform" insert the words --grid as--.

Column 4, line 6: Delete "as illustred" to read line 6: --uniform grid as illustrated in FIGS. 1 and 2, three--.

Column 5, line 13: Change "ferrogmagnetic" to --ferromagnetic--

Column 5, line 18: Delete the word "strutures".

Signed and Sealed this

Twentieth Day of July 1976

[SEAL]

*Attest:*

RUTH C. MASON
*Attesting Officer*

C. MARSHALL DANN
*Commissioner of Patents and Trademarks*